US005343443A

United States Patent [19]

Merewether

[11] Patent Number: 5,343,443

[45] Date of Patent: Aug. 30, 1994

[54] BROADBAND ACOUSTIC TRANSDUCER

[75] Inventor: Ray Merewether, La Jolla, Calif.

[73] Assignee: Rowe, Deines Instruments, Inc., San Diego, Calif.

[21] Appl. No.: 894,175

[22] Filed: Jun. 9, 1992

Related U.S. Application Data

[63] Continuation of Ser. No. 827,838, Jan. 29, 1992, abandoned, which is a continuation of Ser. No. 597,429, Oct. 15, 1990, abandoned.

[51] Int. Cl.[5] ..... H04R 17/00

[52] U.S. Cl. ..... 367/152; 367/157; 367/162; 367/140; 310/325; 310/334; 310/337

[58] Field of Search ..... 367/152, 157, 160, 162, 367/140; 310/325, 334, 337

[56] References Cited

U.S. PATENT DOCUMENTS

| | | | |
|---|---|---|---|
| 4,823,041 | 4/1989 | Inoue et al. | 310/322 |
| 4,907,207 | 3/1990 | Moeckl | 367/163 |

OTHER PUBLICATIONS

Charles S. Desilets, et al., "The Design of Efficient Broad-Band Piezoelectric Transducers", IEEE Transaction on Sonics and Ultrasonics, vol. SU-25, No. 3, May 1978, pp. 115-125.

Takeshi Inoue, et al., "Design of Ultrasonic Transducers with Multiple Acoustic Matching Layers for Medical Application", IEEE Transactions on Ultrasonics, Ferroelectrics, and Frequency Control, vol. UFFC-34, No. 1, Jan. 1987, pp. 8-15.

Henry Beerman, "Optimizing Matching Layers for a Three-Section Broad-Band Piezoelectric PZT-5A Transducer Operating into Water", IEEE Transactions on Sonics and Ultrasonics, vol. SU-28, No. 1, Jan., 1981, pp. 52-53.

Takeshi Inoue, et al., "Wideband Underwater Transducer Array with Single Acoustic Matching Plate", NEC Res. & Develop., No. 86, Jul. 1987, pp. 29-36.

J. A. Brydson, "Phenolic Resins", Plastics Materials, pp. 594-607.

W. Steichen, et al., "Determination of the Power Limits of a High Frequency Transducer Using the Finite Element Method", Proceedings of the International Workshop, Lille, France, May 26-27, 1987, pp. 160-174.

Takeshi Inoue et al., "Investigation for Wide-Band Underwater Ultrasonic Transducers", The Transactions of the IEICE, vol. E70, No. 8, Aug. 1987, pp. 723-733.

A. M. Simpson, "Thermal Expansion and Piezoelectric Response of PZT Channel 5800 for Use in Low-Temperature Scanning Tunneling Microscope Designs", Rev. Sci, Instrum 58 (11), Nov. 1987, pp. 2193-2195.

Ei'ichi Ando, et al., "Finite Element Simulation of Steady-State Heat Problem in Electrostrictive Vibrators", Faculty of Engineering, Toyama University, Trans. Inst. Electron. Inf. Commun. Eng. (Japan), vol. J72-A, No. 6, pp. 881-892, 1989.

*Primary Examiner*—J. Woodrow Eldred

*Attorney, Agent, or Firm*—Knobbe, Martens, Olson & Bear

[57] ABSTRACT

An acoustic transducer having impedance matched layers that can be deployed in environments having wide temperature variations. An anisotropic layer provides a low coefficient of thermal expansion orthogonally to the direction of sound wave propagation. The anisotropic layer may be a solid matrix embedded with fibers, such as glass, arranged in a common orientation.

49 Claims, 2 Drawing Sheets

BROADBAND ACOUSTIC TRANSDUCER

This application is a continuation of application Ser. No. 07/827,838, filed Jan. 29, 1992, now abandoned, which is a continuation of application Ser. No. 07/597,429, filed Oct. 15, 1990, now abandoned.

BACKGROUND OF THE INVENTION

1. Field of the Invention

The present invention relates to ultrasonic transmitters-receivers and, more particularly, to acoustic transducers.

2. Description of the Prior Art

An acoustic transducer performs the operation of converting electrical signals to acoustic signals and/or the inverse operation. Acoustic transducers are presently used in a variety of systems that measure distance or velocity with sound waves. These systems include underwater sonar and medical imaging equipment. In addition to measurement functions, acoustic transducers are used in underwater communications systems, including signal detectors-classifiers. Medical treatment devices, such as those used for the destruction of tumors, also make use of acoustic transducers. For these applications, the acoustic transducers operate at ultrasonic frequencies, i.e., frequencies above the upper limit of human hearing.

As an example of an acoustic transducer application, in many underwater sonar systems, velocity measurements are made using the principle of the Doppler shift. One type of Doppler sonar system is a current profiler. Typically, current profilers are used to measure current velocities in a vertical column of water for each depth "cell" of water up to a maximum range, thus producing a "profile" of water velocities. The general profiler system includes one or more acoustic transducers to generate pulses of sound (which when downconverted to human hearing frequencies sound like "pings") that backscatter as echoes from plankton, small particles, and small-scale inhomogeneities in the water. The received sound has a Doppler frequency shift proportionate to the relative velocity between the scatters and the transducer.

The physics for determining a single velocity vector component ($v_x$) from such a Doppler frequency shift may be concisely stated by the following equation:

$$v_x = \frac{cf_D}{2f_T\cos\theta} \quad (1)$$

In equation (1), c is the velocity of sound in water, which is about 1500 meters/second. Thus, by knowing the transmitted sound frequency, $f_T$, and declination angle of the transmitter transducer, $\theta$, and measuring the received frequency from a single pulse, the Doppler frequency shift, $f_D$, determines one velocity vector component. By adding more transducers, additional components of velocity are measured.

A pulse may comprise one or more cycles of a reference frequency. Profilers characterized by one common type of processing use the echoes from each pulse independently, measuring phase changes over a fraction of the pulse duration to determine the Doppler frequency shift, i.e., $f_D=\theta/T$, where $\theta$ is a phase change calculated from performing an autocorrelation on a received waveform and T is a measurement period.

Such systems estimate the Doppler shift from either the phase change per unit time or the shift in spectral peak of a single pulse echo. The transmitted waveform is typically a periodic pulse train characterized by a pulse repetition interval (PRI). Thus, to provide for a round-trip visit (including echo time) to the particles, or scatterers, in a given depth cell, the maximum profiling range or depth is one-half the PRI. The received echoes are placed in memory bins defined by "time-gating" the received signal, i.e., echoes received at time $t_n$ come from scatterers located at a distance $\frac{1}{2}ct_n$. The width of the gate is usually matched to the pulse length, T, giving a range resolution of $\frac{1}{2}cT$. The velocity (v) of the scatterers in a particular cell is related to the Doppler shift $f_D$ by the following equation:

$$v=\tfrac{1}{2}\lambda f_D \quad (2)$$

where $\lambda$ is the acoustic Wavelength (for example, $\lambda=0.5$ cm at 300 kHz).

Thus, range and velocity resolutions are proportional to the wavelength of the transmitted acoustic signal. A shorter wavelength (higher frequency) will generally improve the accuracy of the spacial-temporal resolutions. However, a longer wavelength (lower frequency) is used to achieve a greater profiling range, or depth, since increased power is available at longer wavelengths. Therefore, no single reference frequency is appropriate for all applications.

Ordinarily, an acoustic signal, or sound wave, is propagated into the water by vibrating a piezoelectric disk, or plate, with an electrical signal; the electrical signal having the same reference frequency as the acoustic signal. The thickness of the piezoelectric plate determines the reference frequency (e.g., a thickness of 6 millimeters produces a frequency of 300 kHz). For a given frequency, the diameter (D) of the plate determines the beamwidth (b) according to the following equation:

$$b=\lambda/D \quad (3)$$

Another consideration in designing acoustic transducers is improving the impulse response (or linearity of frequency transfer between the electrical and acoustic signals) to thereby minimize distortion. Since the impulse response of a system is directly related to the bandwidth, the criteria can be restated as finding a high-efficiency, broadband transducer. Piezoelectric ceramics, although well-recognized as having good impedance matching to electrical signals, also have impedances that are an order of magnitude higher than water, e.g., 33:1.5. It is well-known that bandwidth is narrowed by such impedance mismatching.

Broad bandwidth characteristics are extremely important in newer current profilers wherein multiple pulses are generated into the water "simultaneously" and, in addition, pulses may be modulated.

Researchers have sought to improve impedance matching between the acoustic source (e.g., piezoelectric plate) and the acoustic load, i.e., the medium of sound propagation. One important result by Desilets, et al. ("The Design of Efficient Broad-Band Piezoelectric Transducers", IEEE Transactions on Sonics and Ultrasonics, Vol. SU-25, No. 3, May, 1978, pp. 115–125) showed that impedances of matching layers (i.e., layering the piezoelectric plate with successively lower impedance materials) can be derived according to a binomial relationship already used for transmission lines. However, direct computation of the optimal, matched impedance design was found to be computationally intractable by Inoue, et al. ("Design of Ultrasonic Transducers with Multiple Acoustic Matching Layers for Medical Application", IEEE Transactions on Ultrasonics, Ferroelectrics and Frequency Control, Vol. UFFC-34, No. 1, January, 1987, pp. 8–15). Inoue, et al., nonetheless, made two simplifying assumptions to directly compute the optimal transducer design. First, all layer impedances were specified to be in monotonically decreasing order from the acoustic source to the acoustic load. Second, the ith matching layer thickness ($t_i$) was derived using a common coefficient $a_\lambda$, as presented in the following equation:

$$t_i = a_\lambda \lambda_i / 4 \quad (4)$$

where $\lambda_i$ is the ith matching layer wavelength of the reference frequency.

It has been found, however, that the Inoue, et al., results are not directly transferable to the operating parameters of current profilers. Specifically, medical applications, as indicated by Inoue, et al., typically operate at frequencies above 1 MHz. In contrast, typical frequencies of current profilers are in the range of 50 kHz to somewhat over 1 MHz. Since piezoelectric plate size is a function of frequency (lower frequency transducers requiring larger plates), much larger plate diameters are typically required for current profiler transducers than for medical imaging transducers.

Moreover, current profiler environments are subject to extreme temperature variations. For example, inside the arctic circle, a current profiler transducer can be transferred from air temperatures of −55° C. to ocean water temperatures of 2° C. Just transport of current profilers by air cargo subjects the transducers to temperatures of −40° C.

At the other extreme, temperatures in the Indian Ocean and Red Sea are known to reach 40° C. for several months of the year. At equatorial latitudes, temperatures on the deck of a ship may reach 60° C., and the current profiler can be suddenly transferred from the ship to deep water temperatures that are much cooler.

Under such plate size and temperature constraints, materials that are presently used in acoustic transducers have unacceptable coefficients of thermal expansion. Indeed, when a current profiler using present materials is deployed in an environment subject to wide temperature variations, the piezoelectric plate simply shatters. Thus, a need exists for broadband acoustic transducers, having operating frequencies under 2 Megahertz, that can withstand extreme temperature variations.

SUMMARY OF THE INVENTION

The above-mentioned needs are satisfied by the present invention which includes an acoustic transducer having matched impedance layers which are formed from materials having favorable coefficients of thermal expansion (CTEs). One general class of materials sharing these characteristics are anisotropic materials, i.e., materials having a CTE in one direction, or plane, that is relatively less than a CTE in a second direction.

The present invention includes an acoustic transducer, comprising a plate of a selected size and thickness formed from a piezoelectric material so as to transduce between an electrical signal and a selected acoustic signal, the plate having a first face and a second face, a first conductor in electrical contact with the first face of the plate and a second conductor in electrical contact with the second face of the plate so as to conduct the electrical signal, and an anisotropic material disposed in a layer on the first face of the plate over the first conductor, wherein the anisotropic material has a width and a thickness and provides a selected coefficient of thermal expansion in its radial direction that is different from the coefficient of thermal expansion in its thickness direction.

The acoustic transducer can be further defined such that the piezoelectric material includes lead zirconate titanate. The acoustic transducer can be further defined such that the anisotropic material includes oriented fibers embedded in a polymer. The fiber material can be glass, quartz, carbon or Kevlar®. The polymer can be a phenolic resin. The fibers can be oriented radially from the center of the plate. The anisotropic material can be a liquid crystal polymer.

The acoustic transducer can be further defined such that the acoustic signal is selected to have a center frequency greater than 20 kilohertz and less than 2 Megahertz. Also, the acoustic signal can be selected to have a center frequency greater than 100 kilohertz and less than 1.5 Megahertz. The size of the plate can be selected as a function of the desired acoustic beamwidth. The beamwidth can be less than 30°, and is preferably less than 10°.

The acoustic transducer can be defined such that, in the anisotropic material, the coefficient of thermal expansion in the width direction is less than about 15 ppm/° C. The anisotropic material can include glass fibers impregnated in a phenolic. The anisotropic material can have an impedance in the range of 4–5 Megarayls in the direction of propagation of the acoustic signal. The acoustic transducer can additionally comprise a layer of urethane over the anisotropic material. The acoustic transducer can be defined such that the piezoelectric material includes a ceramic. The diameter of the plate can be from about 30–200 millimeters. The plate thickness can be in the range of about 1–20 millimeters.

Another aspect of the present invention is a transducer for transmitting-receiving an acoustic signal in a medium, comprising an electrode, and a plurality of planar layers, at least one layer connected to the electrode and being a piezoelectric material, wherein the layers are arranged so that layer impedances are monotonically non-increasing from the piezoelectric layer to the medium, and wherein at least one layer is a composite material comprising fibers embedded in a solid matrix, the fibers being of a different composition than the solid matrix, the composite material having a coefficient of thermal expansion substantially less than the solid matrix and an impedance substantially less than the fiber material. The transducer can be defined such that each layer is a quarter-wave thickness. The transducer can be defined such that the electrode includes a layer of glass silver on each side of the piezoelectric layer. The medium can be water. The piezoelectric layer can include a ceramic material.

The transducer can be further defined such that the electrode comprises a layer on the piezoelectric layer and the plurality of layers comprises a layer of glass adjacent to the electrode layer, a layer of anisotropic material having a coefficient of thermal expansion in a first direction that is different from the coefficient of thermal expansion in a second, orthogonal direction, the anisotropic layer adjacent to the glass layer, and a layer of polymeric material formed from the reaction of an isocyanate or isothiocyanate with a polyol adjacent to the anisotropic layer. The glass layer can be bonded to the electrode with epoxy. The polymeric material can comprise polyurethane. The polymeric material can comprise polyurea.

The transducer can be further defined such that the composite material layer comprises fibers embedded in a polymeric compound, wherein the fibers have a selected orientation. The fibers can be glass, quartz, crystalline, including monocrystalline or polycrystalline, graphite or a polyaramid. The orientation of fibers can be radial from an axis in the center of the composite material layer. The orientation of the fibers can be linear within the plane of the composite material layer.

The transducer can be further defined such that the polymeric compound is a phenolic. The composite material can comprise glass fibers embedded in phenolic. The composite material can be selected to have an impedance in the range of about 4–5 Megarayls and a coefficient of thermal expansion in the range of about 0–15 ppm/° C. The center frequency of the transducer can be in the range of 20 kilohertz to 2 Megahertz.

Another aspect of the present invention is an ultrasonic transducer, comprising a piezoelectric plate, a plurality of layers of materials on a face of the plate wherein at least one layer comprises a solid matrix impregnated with crystalline rods, the rods arranged in an alignment parallel to the face of the plate.

These and other objects and features of the present invention will become more fully apparent from the following description and appended claims taken in conjunction with the accompanying drawings.

DETAILED DESCRIPTION OF THE PREFERRED EMBODIMENTS

Reference is now made to the drawings wherein like numerals refer to like parts throughout.

Figure 1:
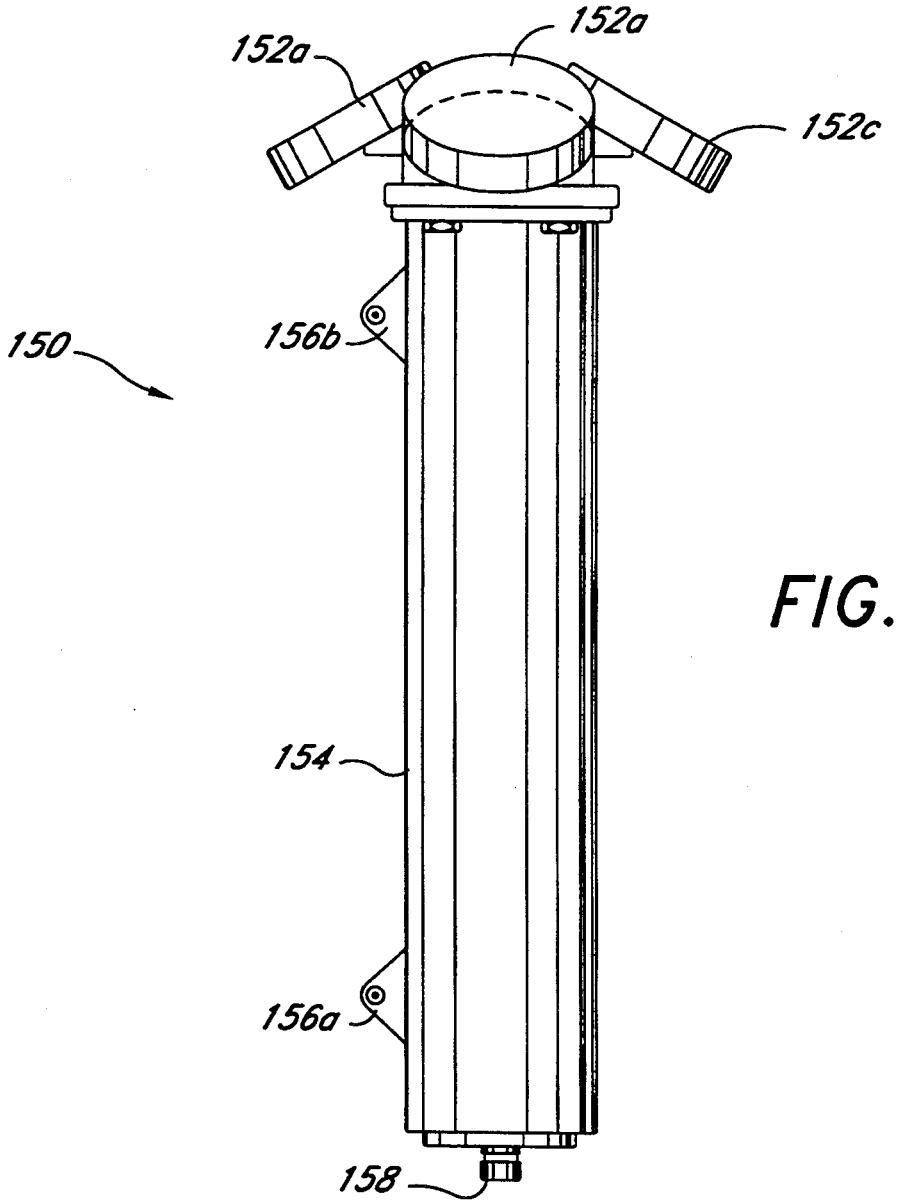
FIG. 1 is a side elevational view of one preferred mechanical assembly for a current profiler which incorporates the present acoustic transducer invention.

FIG. 1 shows a current profiler, generally indicated at 150, that includes a set of four acoustic transducers 152*a, b, c, d* and a cylindrical pressure vessel 154 that houses and protects the electronics which provide electrical signals to the transducers 152. The current profiler 150 may, of course, host other numbers and configurations of transducers than the four transducers shown in FIG. 1. It should also be understood that the current profiler 150 is but one of a number of applications for the acoustic transducer of the present invention.

The acoustic transducers 152, shown in FIG. 1, are typically manufactured so that they operate at a particular reference frequency chosen from a suitable range of frequencies such as, for example, 150, 300, 600 and 1200 kilohertz. Low-frequency transducers are commonly used in open ocean applications where a long profiling range is desirable. High-frequency transducers, on the other hand, are used in shallow water applications where depth resolution, as characterized by the size of a depth cell, and finer spatial and temporal scales are important. The transducers 152 are manufactured to be easily substitutable on the current profiler assembly 150 so that the proper acoustic frequency can be used to achieve the desired combination of profiling range and velocity resolution, which may vary from one velocity profiling experiment to another. One possible range of transducer frequencies is between about 20 kHz and 2 MHz although, more preferably, frequencies are in the range of about 100 kHz to 1.5 MHz. A top plan view of the transducers 152 is illustrated in FIG. 2.

The transducers 152 are positioned at 90° intervals of azimuth around the periphery of the pressure vessel 154 in the so-called Janus configuration. To achieve multiple degrees of freedom in calculating orthogonal components of velocity, the transducers 152 are canted outward from the longitudinal axis of the pressure vessel 154. The current profiler 150 is conveniently positioned in the water by connecting one or more cables and/or buoys (not shown) to a pair of mounting lugs 156*a, b* located on one side of the pressure vessel 154. Real-time control of the current profiler 150 is optionally obtained by connecting a communications cable (not shown) to an I/O port 158 located at the end of the pressure vessel 154 that is opposite to the transducers 152.

Figure 2:
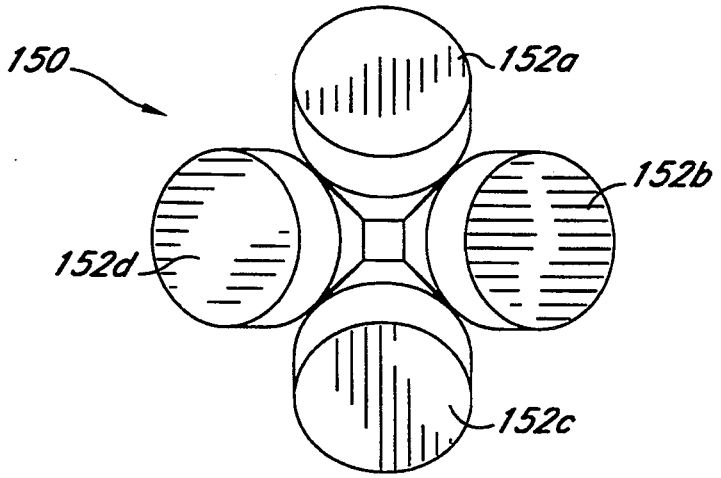
FIG. 2 is a top plan view of the current profiler shown in FIG. 1.

In the current profiler 150 shown in FIGS. 1 and 2, the transducers 152 are monostatic, i.e., the transmitting-receiving function is performed by each transducer 152. However, bistatic configurations of transducers, wherein each transducer performs only the transmit or receive function, may also take advantage of the present invention. Also, as is well-known in the technology, acoustic transducers can be used for communication functions.

Figure 3:
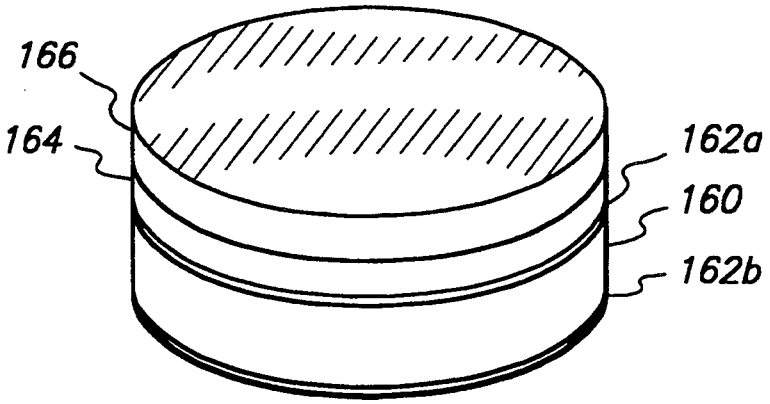
FIG. 3 is a perspective view of a single-layer matched impedance embodiment of the acoustic transducer according to the present invention.

FIG. 3 shows the details of one presently preferred embodiment of the acoustic transducer 152 (FIG. 2), called a single-layer matched impedance transducer. A piezoelectric plate 160 is covered on both faces by electrodes 162*a, b*. The piezoelectric plate 160 is preferably formed from a ceramic material such as lead zirconate titanate (known in the industry as "PZT"). The piezoelectric plate 160, which is typically circular on its faces, has a thickness that is determined according to the desired reference frequency. The desired beamwidth determines the diameter of the plate 160 (equation (3)). Thus, Table 1, below, presents the dimensions of four representative piezoelectric plates that vary in frequency and beamwidth, although, of course, others are possible.

TABLE 1

| | | | | |
|---|---|---|---|---|
| Frequency | 150 kHz | 300 kHz | 600 kHz | 1.2 MHz |
| Diameter | 165 mm | 134 mm | 101 mm | 55 mm |
| Thickness | 13.5 mm | 6 mm | 3.2 mm | 1.5 mm |

The plates specified in Table 1 may be purchased from Edo Western of Salt Lake City, Utah. In general, the present invention realizes advantages over present technology when the diameter of the acoustic transducer, including the piezoelectric plate 160, is about 30 mm–200 mm. So, in present embodiments beamwidths of less than 30° are preferred, and beamwidths of less than 10° even more so. Due to the preferred range of frequencies, plate thicknesses of 1–20 mm are preferred.

A layer of material 164 covers the electrode 162*a* on the side of the plate 160 that propagates an acoustic signal. The layer 164 is a material that exhibits a matched impedance in accordance with established practices of the current technology. However, in addition, this layer may be anisotropic with respect to its coefficient of thermal expansion (CTE). In other words, the coefficient of thermal expansion along the plane of the plate face is lower than that along the direction of sound propagation (i.e., the orthogonal direction). For example, in one preferred embodiment, the anisotropic material has an impedance Z=4.2 Megarayls and a CTE=13 parts-per-million/° C. in the planar direction. The thickness of the layer can be arrived at using equation (4) and the common coefficient determined using the method of Inoue, et al. This thickness is referred to herein as the quarter-wave thickness of a matched impedance layer. For example, in one embodiment, the following quarter-wave thicknesses are preferred: 1.2 MHz–0.56 mm; 600 kHz–1.12 mm, 300 kHz–2.24 mm, 150 kHz–4.48 mm. Although quarter-wave thicknesses are preferred, other thicknesses which maintain matched impedances are acceptable.

The anisotropic layer 164 (the material of the layer 164 is hereafter referred to as anisotropic, although any material having an impedance of about 4–5 Megarayls and a CTE of about 0–15 ppm/° C. is acceptable) may be a matrix of solid material, such as a polymer, which is impregnated with fibers of amorphous, monocrystalline or polycrystalline structures. One presently preferred anisotropic material is sold under the tradename XB-22 by Rogers of Manchester, Conn. In XB-22, the solid matrix is a phenolic resin composed of novolak cross-linked with hexamethylene tetramine and the fibers are made of a composite grade glass, sometimes referred to as S-glass, having a diameter of about 10 microns and a length of about 500 microns. Other glass fibers, for example, those having diameters of 1–40 microns and lengths of 100–2000 microns may also be used. A description of novolaks and their preparation is presented in Chapter 23 of *Plastics Materials* by J. A. Brydson, published by Butterworths, which is hereby incorporated by reference.

Other polymers, such as other phenolic resins (e.g., phenol-furfural resins or polymers of phenol with other aldehydes), epoxy resins, and the like, may be used for the solid matrix. Polyester resins of appropriate CTE and impedance may also be used. Other suitable materials for fibers are quartz, graphite (including PAN graphite), other forms of carbon fiber, and polyaramid materials (such as that sold by du Pont, Wilmington, Del., under the trademark Kevlar®). Also, boron nitride, silicon carbide, aluminum oxide, aluminum silicate and fibers of other ceramics are suitable.

In the case of XB-22, the fibers and solid matrix are two different materials. The composite material formed by the combination of the materials has a coefficient of thermal expansion substantially less than that of the solid matrix and an impedance substantially less than the fiber material. Thus, the composite material provides a material that is more suitable for the present invention than either material individually.

To make the layer 164 anisotropic, the fibers should be arranged in a common orientation, such as in a common plane. Fiber orientation techniques are well-known. Linear and radial orientations are presently preferred. Other materials may not need intentional orientation as the fibers or molecules may naturally have a low coefficient of thermal expansion in the planar direction. For example, liquid crystal polymers, such as those selected from nematic, smectic and cholesteric groups, may be acceptable anisotropic materials.

One preferred bonding agent between the anisotropic layer 164 and the electrode 162 is a diglycidylether of bis-phenol-A (DGEBA) sold under the trademark Dexter Hysol 2039 resin, cured with a polyglycol amine, such as Dexter 3561 hardener. The resin is spread on the electrode 162 to a thickness of about 10 microns.

A protective layer 166 covers the anisotropic layer. The protective layer 166 contacts the water when the transducer is underwater. The protective layer 166 is generally a polymeric material formed from the condensation of a polyol and an isocyanate, such as a polyurethane or polyurea compounds. For instance, the urethane sold under the tradename HMP85-1 Slow, distributed by Fluid Polymers of Las Vegas, Nev. can be used in the protective layer 166. The thickness of the protective layer 166 is preferably around 1 millimeter and, as the layer 166 is a negligible contributor to impedance matching in the single-layer embodiment, it is not necessary to use a quarter-wave thickness.

In the current profiler 150 (FIG. 1) that includes the present invention, the transducers 152 (FIG. 2) also have layers of one or more materials on the plate face opposed to the direction of sound wave propagation. In one current profiler embodiment, the opposing face of the piezoelectric plate 160 is covered with a quarter-wave layer of silicone rubber, a quarter-wave layer of glass, and a layer of lead shot embedded in urethane. The shot-embedded urethane is then supported by an aluminum base (not shown) on the current profiler 150.

Figure 4:
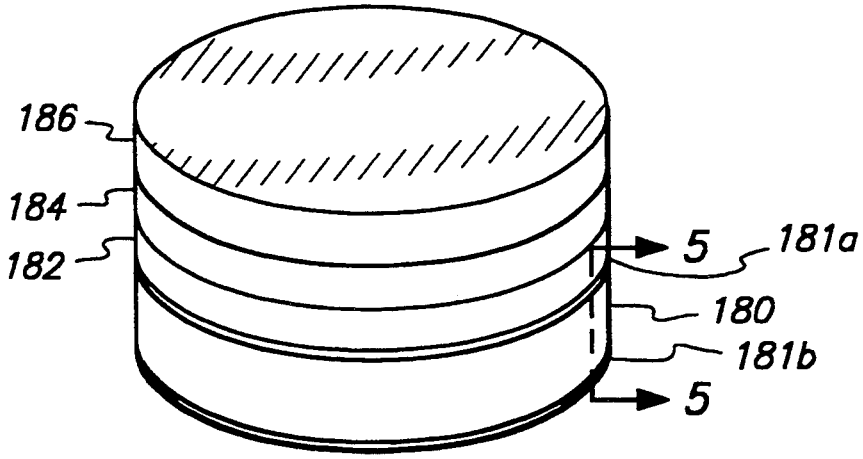
FIG. 4 is a perspective view of a three-layer matched impedance embodiment of the acoustic transducer according to the present invention.

Turning now to FIG. 4, one presently preferred embodiment of a three-layer matched impedance transducer is therein depicted. A piezoelectric plate 180, of similar material, thickness and size to the plate 160 previously described and shown in FIG. 3, is covered with electrodes 181*a,b* and an intermediate layer 182. The intermediate layer 182 is preferably a glass such as ordinary window glass having quarter-wave thicknesses according to current profiler frequencies as follows: 150 kHz–⅜"; 300 kHz–3/16"; 600 kHz–3/32"; and 1.2 MHz–1.2 mm (microscope glass).

The intermediate layer 182 is covered with an anisotropic layer 184, of similar material, thickness and size to the layer 162 previously described and shown in FIG. 3. As previously discussed, although anisotropic materials are presently preferred, any material having an impedance of about 4–5 Megarayls and a CTE of about 0–15 ppm/° C. is satisfactory. An outer layer 186, preferably formed from a polymeric material such as urethane, covers the anisotropic layer 184. In the three-layer matched impedance transducer, the outer layer 186 should be a quarter-wave thickness. One suitable material for the outer layer 186 is a urethane available from Ren Plastics, a division of Ciba Geigy, of East Lansing, Mich., sold under the tradename RP6402, or EP30DP distributed by Master Bond of Teaneck, N.J. Besides contributing to impedance matching, the outer layer 186 also functions to protect the transducer from water.

Table 2, presented below, shows the approximate impedances (Z), in Megarayls, and coefficients of thermal expansion (CTE), in ppm/° C., of one presently preferred embodiment of the three-layer matched impedance transducer.

TABLE 2

| | Z | CTE |
|---|---|---|
| Protective Layer (e.g., RP6402) | 1.9 | 100 |
| Anisotropic Layer (e.g., XB-22) | 4.2 | 13 |
| Intermediate Layer (e.g., glass) | 14.4 | 10 |
| Piezoelectric Plate (e.g., PZT) | 33.0 | 3.5 |

Figure 5:
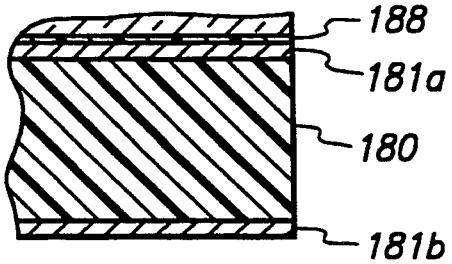
FIG. 5 is a cross-sectional view of a portion of the acoustic transducer shown in FIG. 4, taken along lines 5—5.

It has been found that the preparation of surfaces is important for the preferred three-layer matched impedance transducer. FIG. 5 is a cross-sectional view of a portion of the transducer illustrated in FIG. 4.

The electrode 181, comprising a layer of glass silver about 10 microns thick, is preferably a frit (i.e., crumbled glass). The frit is silkscreened onto the piezoelectric plate 180 and is allowed to evaporate until dry. The heated glass thus melts and fuses to the ceramic material of the plate. One preferred frit material is sold by du Pont under the tradename 7095.

Since the intermediate layer 182 is preferably glass, the piezoelectric plate 180, including the electrode 181*a*, should be smoothed to promote even contact between layers. Toward this end, high points, or bumps, on the plate 180 are hand-lapped with a fine grade India stone. The India stone presently being used has an effective surface area defined by a 20 mm diameter. The stone size is important as bumps larger than about 20 mm, which are related to the shape of the plate after manufacture, are not affected. On the other hand, the stone is small enough to prevent a wearing away of portions of the electrode 181*a*. The stone should be of an intermediate grit, such as, for example, between 240 and 400 grit, preferably about 320 grit. Such a grit is rough enough to prevent a mirror-like surface forming on the plate 180 and thus provide a good bonding surface. Thus, the hand-lapping process selectively removes bumps that are small in relation to the stone.

In addition, during the lapping process, it is helpful to use a lubricant such as, for example, 1,1,1-trichloroethane. The lubricant flushes particles away from the electrode 181*a* and is chosen so as not to contaminate the surface of the electrode 181*a*.

Such surface preparation of the piezoelectric plate 180 provides a uniform bond with the intermediate layer 182. An epoxy layer 188, about 1–3 microns thick, bonds the intermediate layer 182 (FIG. 4), such as glass, to the electrode 181*a*. Thus, by smoothing the piezoelectric plate 180 and electrode 181*a*, the thickness of the epoxy layer is reduced so as to not interfere in the effect of impedance matching.

Thus, the anisotropic layer as an impedance matching layer provides the advantage over the prior technology of allowing a broadband acoustic transducer to be deployed across wide temperature variations. The single-layer transducer is easy to manufacture and provides enough broadband tolerance for many current profiler applications. The three-layer transducer, however, provides improved bandwidth over the single-layer transducer. Although single-layer and three-layer matched impedance transducers have been shown and described, one skilled in the relevant technology will readily comprehend that any number of matched impedance layers can take advantage of one or more anisotropic layers according to the present invention. It will also be understood by those familiar with acoustic transducers, that many other applications of the present invention are possible including, to name just a few, underwater communications, medical imaging and tumor destruction.

While the above detailed description has shown, described and pointed out the fundamental novel features of the invention as applied to various embodiments, it will be understood that various omissions and substitutions and changes in the form and details of the device illustrated may be made by those skilled in the art, without departing from the spirit of the invention.

What is claimed is:

1. An acoustic transducer, comprising:

a plate of a selected size and thickness formed from a piezoelectric material so as to transduce between an electrical signal and a selected acoustic signal, said plate having a first face and a second face;

a first conductor in electrical contact with the first face of said plate and a second conductor in electrical contact with the second face of said plate so as to conduct said electrical signal; and an anisotropic material containing similar numbers of oriented fibers disposed evenly in any two selected perpendicular directions along a layer on the first face of said plate over said first conductor, wherein said anisotropic material has a width and a thickness and said oriented fibers provide a radially uniform coefficient of thermal expansion in any two selected perpendicular directions along the width direction that is different from the coefficient of thermal expansion in the thickness direction.

2. The acoustic transducer as defined in claim 1, wherein the piezoelectric material includes lead zirconate titanate.

3. The acoustic transducer as defined in claim 1, wherein the anisotropic material includes oriented fibers embedded linearly in a polymer.

4. The acoustic transducer as defined in claim 3, wherein the fiber material comprises glass.

5. The acoustic transducer as defined in claim 3, wherein the fiber material comprises quartz.

6. The acoustic transducer as defined in claim 3, wherein the fiber material comprises carbon.

7. The acoustic transducer as defined in claim 3, wherein the fiber material comprises an aramid fiber.

8. The acoustic transducer as defined in claim 3, wherein the polymer is a phenolic resin.

9. The acoustic transducer as defined in claim 3, wherein the fibers are oriented radially from the center of said plate.

10. The acoustic transducer as defined in claim 1, wherein the anisotropic material is a liquid crystal polymer.

11. The acoustic transducer as defined in claim 1, wherein the acoustic signal is selected to have a center frequency greater than 20 kilohertz and less than 2 Megahertz.

12. The acoustic transducer as defined in claim 1, wherein the acoustic signal is selected to have a center frequency greater than 100 kilohertz and less than 1.5 Megahertz.

13. The acoustic transducer as defined in claim 1, wherein the size of the plate is selected as a function of the desired acoustic beamwidth.

14. The acoustic transducer as defined in claim 13, wherein the beamwidth is less than 30°.

15. The acoustic transducer as defined in claim 13, wherein the beamwidth is less than 10°.

16. The acoustic transducer as defined in claim 1, wherein the coefficient of thermal expansion in the width direction is less than about 15 ppm/° C.

17. The acoustic transducer as defined in claim 1, wherein the anisotropic material includes glass fibers impregnated in a phenolic resin.

18. The acoustic transducer as defined in claim 1, wherein the anisotropic material has an impedance in the range of 4–5 Megarayls in the direction of propagation of the acoustic signal.

19. The acoustic transducer as defined in claim 1, additionally comprising a layer of urethane over the anisotropic material.

20. The acoustic transducer as defined in claim 1, wherein the piezoelectric material comprises a ceramic.

21. The acoustic transducer as defined in claim 1, wherein the diameter of the plate is from about 30–200 millimeters.

22. The acoustic transducer as defined in claim 1, wherein the plate thickness is in the range of about 1–20 millimeters.

23. A transducer for transmitting-receiving an acoustic signal in a medium, comprising:

an electrode; and a plurality of planar layers, at least one layer connected to said electrode and being a piezoelectric material, wherein the layers are arranged so that layer acoustical impedances are monotonically non-increasing from the piezoelectric layer to the medium, and wherein at least one layer is a composite material comprising similar numbers of oriented fibers disposed evenly in any two selected perpendicular directions along the face of said composite layer, said fibers being embedded in a solid matrix and of a different composition than the solid matrix, said composite material also having a radially uniform coefficient of thermal expansion in the planar direction substantially less than the solid matrix and an impedance perpendicular to the fibers substantially less than the fiber material.

24. The transducer as defined in claim 23, wherein each layer is a quarter-wavelength in thickness, and wherein a wavelength is defined as the speed of sound in each layer divided by the operating frequency.

25. The transducer as defined in claim 23, wherein the electrode includes a silvered glass frit on each side of the piezoelectric layer.

26. The transducer as defined in claim 23, wherein the medium is water.

27. The transducer as defined in claim 23, wherein the piezoelectric layer includes a ceramic material.

28. The transducer as defined in claim 23, wherein the electrode comprises a layer on the piezoelectric layer and the plurality of layers comprises:

a layer of glass adjacent to the electrode layer;

a layer of anisotropic material containing uniformly oriented fibers having a coefficient of thermal expansion in that is different from the coefficient of thermal expansion in the orthogonal direction to the plane, said anisotropic layer adjacent to the glass layer; and a layer of polymeric material adjacent to said anisotropic layer.

29. The transducer as defined in claim 28, wherein the glass layer is bonded to the electrode with epoxy.

30. The transducer as defined in claim 28, wherein the polymeric material comprises polyurethane.

31. The transducer as defined in claim 28, wherein the polymeric material comprises polyurea.

32. The transducer as defined in claim 23, wherein the composite material layer comprises fibers embedded in a polymeric compound, wherein said fibers have a selected orientation.

33. The transducer as defined in claim 32, wherein the fibers are a glass.

34. The transducer as defined in claim 33, wherein the fibers are quartz.

35. The transducer as defined in claim 32, wherein the fibers are crystalline.

36. The transducer as defined in claim 35, wherein the fibers are monocrystalline.

37. The transducer as defined in claim 35, wherein the fibers are polycrystalline.

38. The transducer as defined in claim 37, wherein the fibers are graphite.

39. The transducer as defined in claim 32, wherein the fibers are a polyaramid.

40. The transducer as defined in claim 32, wherein the orientation is radial from an axis in the center of the composite material layer.

41. The transducer as defined in claim 32, wherein the orientation is linear within the plane of the composite material layer.

42. The transducer as defined in claim 32, wherein the polymeric compound is a phenolic.

43. The transducer as defined in claim 23, wherein the composite material comprises glass fibers embedded in a phenolic resin.

44. The transducer as defined in claim 23, wherein the composite material is selected to have an impedance in the range of about 4–5 Megarayls and a coefficient of thermal expansion in the range of about 0–15 ppm/° C.

45. The transducer as defined in claim 23, wherein the i center frequency of the transducer is in the range of 20 kilohertz to 2 Megahertz.

46. An ultrasonic transducer, comprising:

a piezoelectric plate;

a plurality of layers of materials on a face of the plate wherein at least one layer comprises a solid matrix impregnated with similar numbers of crystalline rods disposed evenly in any two perpendicular directions along said solid matrix layer, the rods arranged in an alignment parallel to the face of the plate and so as to provide a uniform coefficient of thermal expansion across the plane of the layer.

47. A process of combining a rough piezoelectric plate having a frit electrode with a matched impedance material in the manufacture of an acoustic transducer, the process comprising the steps of:

smoothing the frit electrode surface of the piezoelectric plate so as to reduce the thickness of adhesive required to bond an impedance matched layer thereto;

laying an adhesive on the smoothed surface of the piezoelectric plate; and covering the adhesive with a layer of an impedance matched material.

48. The transducer as defined in claim 28, wherein said layer of polymeric material is formed from the reaction of an isothiocyanate and a polyol.

49. The transducer as defined in claim 28, wherein said layer of polymeric material is formed from the reaction of an isocyanate and a polyol.

* * * * *